US006357150B1

(12) United States Patent
Satzler

(10) Patent No.: US 6,357,150 B1
(45) Date of Patent: Mar. 19, 2002

(54) SPADE WHEEL APPARATUS FOR DREDGING EQUIPMENT AND ASSOCIATED METHOD

(75) Inventor: Ronnie L. Satzler, Princeville, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/529,693

(22) PCT Filed: Mar. 24, 2000

(86) PCT No.: PCT/US00/07951

§ 371 Date: Apr. 18, 2000

§ 102(e) Date: Apr. 18, 2000

(51) Int. Cl.[7] ..... E02F 3/08
(52) U.S. Cl. ..... 37/337; 37/352; 37/190
(58) Field of Search ..... 37/91–93, 189, 37/190, 309, 337, 338, 347, 348, 350–355, 901; 172/39, 55, 559

(56) References Cited

U.S. PATENT DOCUMENTS 4,267,652 A 5/1981 Senesac
4,290,890 A 9/1981 Bauer
4,658,751 A 4/1987 Koot
4,887,371 A 12/1989 Kaiser
5,638,620 A 6/1997 Van Der Kooy
5,782,660 A 7/1998 Brickell et al.
5,903,989 A 5/1999 Satzler
5,907,915 A 6/1999 Satzler
5,960,570 A 10/1999 Satzler

*Primary Examiner*—Robert E. Pezzuto
(74) *Attorney, Agent, or Firm*—Blackwell Sanders Peper Martin, LLP

(57) ABSTRACT

A rotating drive wheel assembly for steering and maneuvering a dredging apparatus includes a carrier wheel and an orientation wheel connected to opposite ends of a pivotation member. A plurality of spade devices are connected to the wheels, each including a blade portion pivotally coupled to a spoke plate of the carrier wheel, and an arm portion pivotally coupled at opposite ends to the outer portion of the carrier wheel and another carrier wheel spoke plate member. The construction of the present drive wheel assembly allows the spade devices to remain in a substantially vertical orientation when the carrier wheel is rotated about its axis of rotation.

31 Claims, 3 Drawing Sheets

SPADE WHEEL APPARATUS FOR DREDGING EQUIPMENT AND ASSOCIATED METHOD

TECHNICAL FIELD

This invention relates generally to locomotion mechanism for dredging apparatus and associated method and, more particularly, to a spade wheel mechanism for propelling and maneuvering dredging apparatus in a body of water.

BACKGROUND ART

Various types of dredging apparatus are known in the art for removing silt, sand, mud or other sediment material from the bottom of a body of water. One such dredging apparatus is disclosed in U.S. Pat. No. 5,960,570 and includes a floatation arrangement operative to float on the surface of the body of water, a frame structure mounted on the floatation arrangement, and a silt excavating wheel mechanism rotatably mounted to the frame structure and operative to extract silt from under the body of water. Such apparatus also typically includes a height adjustment mechanism operative to raise and lower the excavating wheel mechanism relative to the surface of the water and may include a conveyor arrangement operative to transport the extracted silt away from the excavating wheel mechanism.

Typically, dredging apparatus likewise have mechanisms and/or systems for propelling and maneuvering the apparatus relative to the floor of the body of water. Usually, such drive mechanisms include a pair of drive wheels positioned one on each side of the dredging equipment to engage the floor of the body of water in order to propel and maneuver the dredging equipment relative thereto. However, due to the relatively loose, soft and slippery material typically present on the floor surfaces of bodies of water, the drive wheels may not always properly engage the floor surface whereby propelling or maneuvering such heavy equipment relative thereto becomes difficult, cumbersome and inefficient. Further, the contact between the drive wheels and the floor surface results in displacement of the relatively loose sediment material present at the floor surface into the surrounding water. Sediment material thus displaced causes undesirable turbidity in the surrounding water, which is particularly undesirable in the vicinity of the dredging wheel mechanism. It is accordingly preferable to minimize the amount of turbidity caused by the drive wheel mechanism associated with dredging apparatus during a dredging operation.

Therefore, it is desirable to provide a drive wheel mechanism for dredging apparatus which reliably engages the floor of a body of water during dredging operations, which permits efficient propulsion and navigation of the dredging apparatus relative to the floor of the body of water, and which does not cause turbidity in the vicinity of the dredging wheel mechanism during a dredging operation.

Accordingly, the present invention is directed to overcoming one or more of the problems as set forth above.

DISCLOSURE OF THE INVENTION

In one aspect of the present invention a drive wheel assembly adapted for use for propelling a dredging apparatus in a body of water is disclosed. The drive wheel assembly includes a carrier wheel rotatably coupled to the dredging apparatus, the carrier wheel including an axis member at the center thereof defining the center of rotation of the carrier wheel, a first member coupled to one end of the axis member and a second member coupled to the other end of the axis member, a pivotation member having opposed end portions, one end portion of the pivotation member being coupled to the center axis member of the carrier wheel, an orientation wheel pivotally connected to the opposed end portion of the pivotation member, and a plurality of spade devices pivotally connected to the carrier wheel and to the orientation wheel, each spade device including an arm portion and a blade portion, each arm portion having opposed end portions, one end portion of each arm portion being pivotally coupled to the orientation wheel and the opposite end portion of each arm portion being pivotally coupled to the first member associated with the carrier wheel, each blade portion having a portion thereof pivotally coupled to the second member associated with the carrier wheel whereby the spade devices are positioned in a substantially vertical orientation relation to the horizontal.

In another aspect of this invention, a method for assembling a drive wheel assembly adapted for use for propelling a dredging apparatus in a body of water is disclosed. The method includes the steps of rotatably coupling a carrier wheel to the dredging apparatus, the carrier wheel including an axis member at the center thereof defining the center of rotation of the carrier wheel, coupling a first member to one end of the axis member, coupling a second member to the other end of the axis member, pivotally connecting an orientation wheel to the opposed end portion of a pivotation member, the pivotation member having opposed end portions, one end portion of the pivotation member being coupled to the center axis member of the carrier wheel, pivotally connecting a plurality of spade devices to the carrier wheel and to the orientation wheel, each spade device including an arm portion and a blade portion, each arm portion having opposed end portions, pivotally coupling one end portion of each arm portion to the orientation wheel, pivotally coupling the opposite end portion of each arm portion to the first member associated with the carrier wheel, pivotally coupling each blade portion having a portion thereof to the second member associated with the carrier wheel, and positioning the spade devices in a substantially vertical orientation relation to the horizontal.

BRIEF DESCRIPTION OF THE DRAWINGS

For a better understanding of the present invention, reference may be made to the accompanying drawings in which.

BEST MODE FOR CARRYING OUT THE INVENTION

Figure 1:
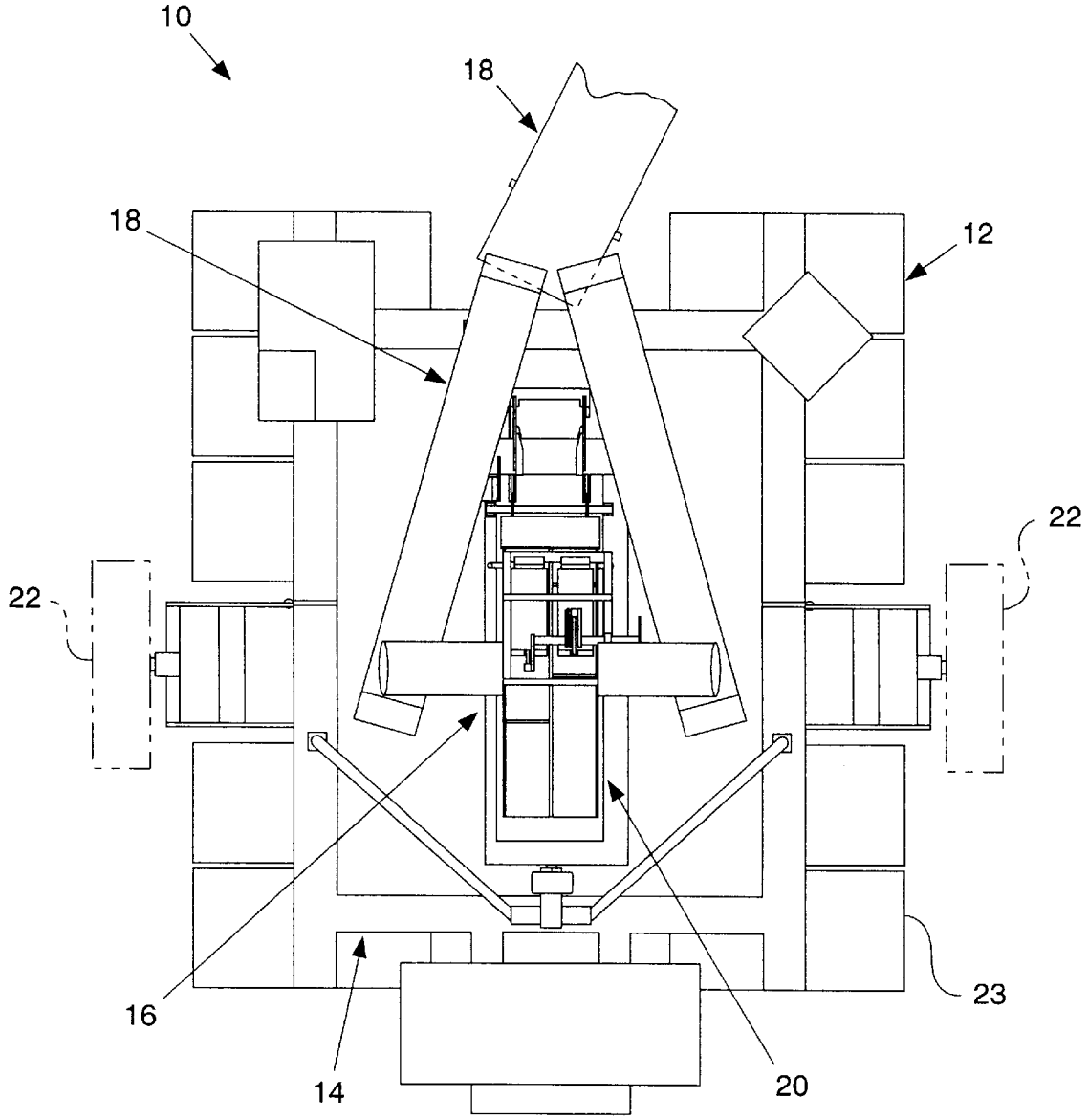
FIG. 1 is a partial top elevational view of a typical dredging apparatus incorporating the present invention.

Referring to the drawings, FIG. 1 discloses a portion of a dredging apparatus 10 which is adapted to remove silt from under a body of water, the apparatus 10 including a floatation arrangement 12, a base frame structure 14 connected to floatation arrangement 12, a silt excavating wheel mechanism 16 operative to remove silt from underneath the body of water, a pair of shield/shoe mechanisms (not shown) operative to shield wheel mechanism 16 from the water while silt is being removed from the bottom of the body of water, an ejector mechanism 20 operative to aid in the removal of silt from wheel mechanism 16, and two drive wheel assemblies 22 operative to propel and maneuver apparatus 10 in a body of water. A typical dredging apparatus such as apparatus 10 would also include a conveying system 18 operative to transport the silt away from the wheel mechanism 16.

Floatation arrangement 12 includes a plurality of individual floats 23 interconnected to each other by frame structure 14 to form a base platform. Floatation arrangement 12 also includes a buoyancy control arrangement operative to control the level of the platform by increasing or decreasing the buoyancy of at least certain ones of the plurality of floats 23 in order to compensate for changes in weight distribution. The silt excavating wheel mechanism 16 includes a wheel frame assembly pivotally connected to frame structure 14 at a plurality of pivot points (not shown), and a height adjusting mechanism (not shown). Apparatus 10 will typically also include a conveyor system 18 to transport excavated silt away from apparatus 10 and, in that regard, a wide variety of different types of conveyor systems can be utilized with dredging apparatus 10 without departing from the spirit and scope of the present invention. An appropriate conveyor mechanism such as conveyor system illustrated in U.S. Pat. No. 5,960,570 would be operatively located to receive the removed silt from the silt removal wheel mechanisms and thereafter transport and deposit such silt at an appropriate storage location such as onto a barge or some other transporting device.

Figure 2:
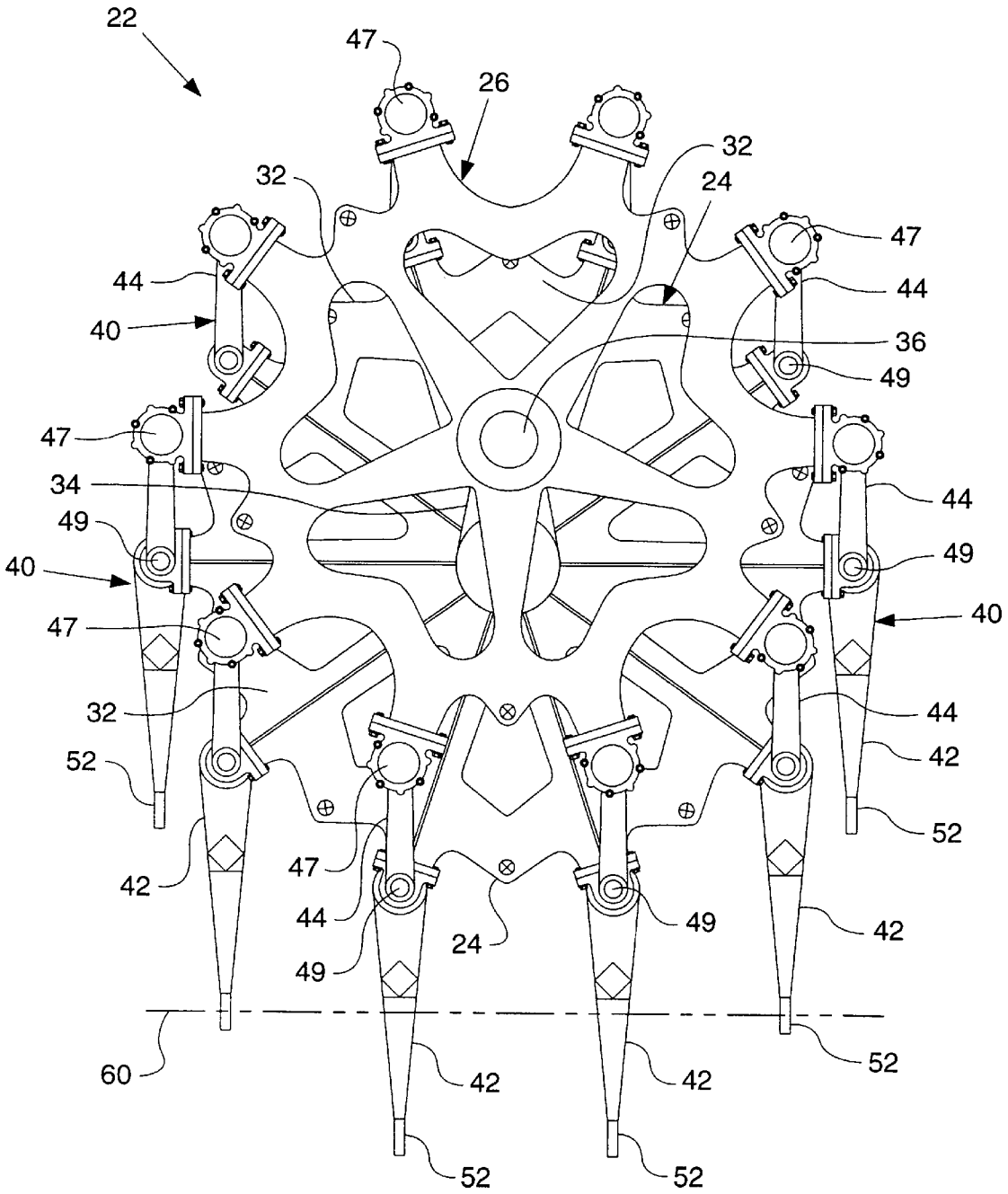
FIG. 2 is a side view of a drive wheel assembly constructed according to one embodiment of the present invention.
Figure 3:
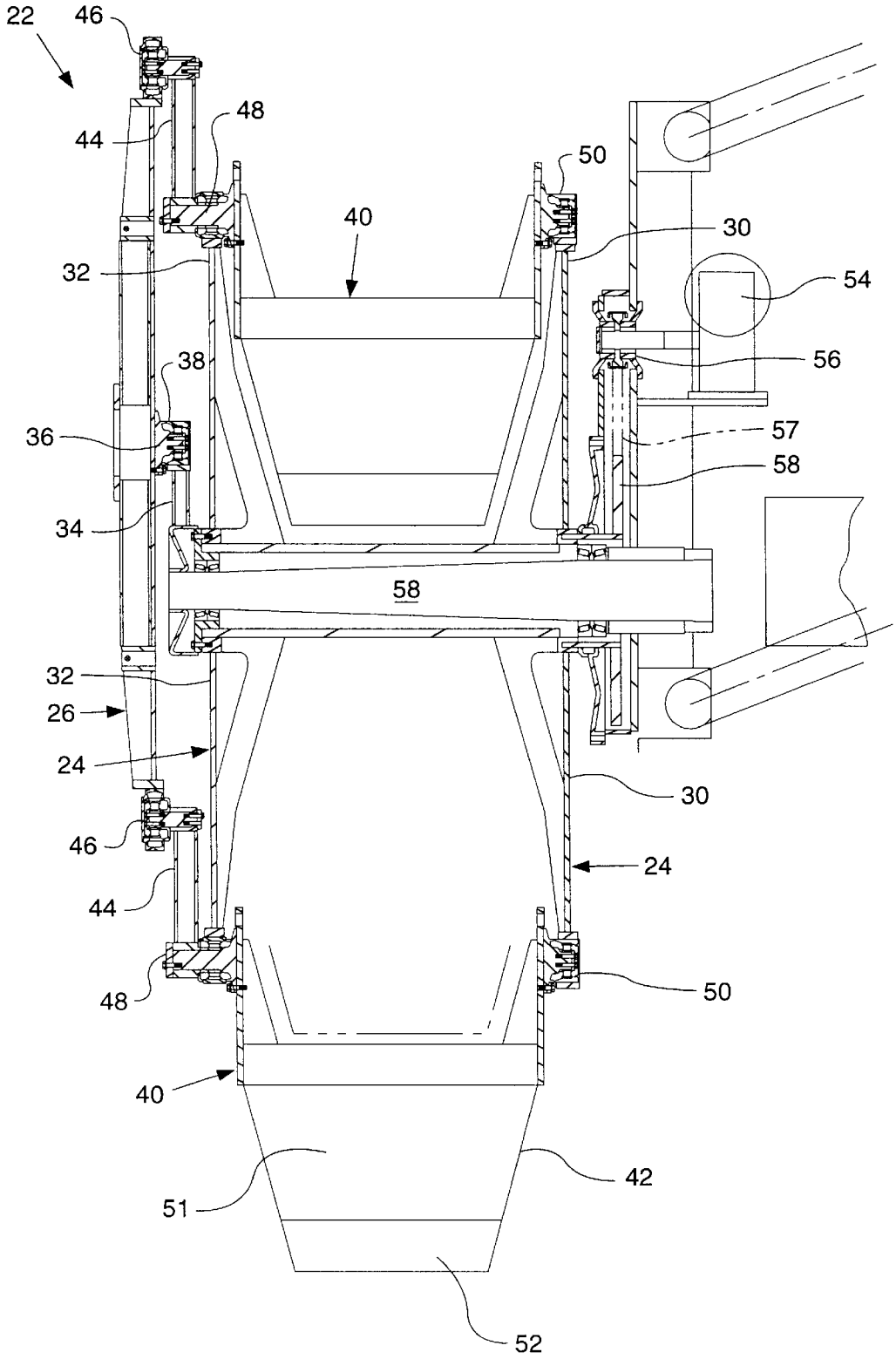
FIG. 3 is a front elevational view of the drive wheel assembly illustrated in FIG. 2.

In addition, a typical dredging apparatus will include a propulsion and steering system. These systems typically include a pair of independent drive wheel assemblies 22 operable to both propel the dredging apparatus 10 as well as steer apparatus 10 in a body of water. Referring to FIGS. 2 and 3, a drive wheel assembly 22 constructed according to the teachings of one embodiment of the present invention is shown. Each drive wheel assembly 22 is preferably adjustably connected to apparatus 10 whereby the height of wheel assembly 22 relative to apparatus 10 is variable and adjustable such that apparatus 10 may be operable in bodies of water having a variety of depths. It is recognized and anticipated that any position or height adjustment mechanism known in the art may be utilized for this purpose such as those mechanisms disclosed in U.S. Pat. Nos. 5,907,915 and 5,960,570. It is, however, recognized and anticipated that drive wheel assemblies 22 may also be fixed relative to apparatus 10 in particular embodiments of the present invention.

Drive wheel assembly 22 includes a carrier wheel 24, and an orientation wheel 26 which is positioned vertically or radially offset relative to carrier wheel 24. Carrier wheel 24 includes an axis member 28 at the center thereof and two spoked plate members 30 and 32 connected respectively to the opposite ends of axis member 28. Plate members 30 and 32 are preferably substantially identical to each other, the plate members 30 and 32 connected to axis member 28 being clearly illustrated in FIG. 3 while only portions of plate member 32 are visible in FIG. 2. A pivotation or linkage member 34 is rigidly connected to axis member 28 at one end portion thereof and its other end portion 38 which includes a pivot mechanism 36 is pivotally connected to the center of orientation wheel 26. As a result, pivot mechanism 36 is substantially vertically or radially offset relative to axis member 28. It can be appreciated that member 34 provides a substantially vertical or radial offset between wheels 24 and 26 by approximately the same distance as the length of the member 34.

Referring to FIGS. 2 and 3, drive wheel assembly 22 also includes a plurality of spade devices 40, each of which is connected to both wheels 24 and 26. Each spade device 40 includes a blade portion 42, an arm portion 44, an orientation wheel pivot mechanism 46, and a pair of carrier wheel pivot mechanism 48 and 50. In the preferred embodiment, each spade device 40 and its various components are constructed integrally in order to provide durability and strength to the overall spade device 40 as well as to the interrelationships amongst its various components. However, it is recognized and anticipated that the various components may be individually distinct and substantially rigidly connected to each other.

Blade portion 42 of each spade device 40 is shown as being of a trapezoidally shaped plate member 51 with a relatively flat surface area on each side thereof, the plate member 51 having tapered side edges that conclude in a tip portion 52. The tapered side edges of plate member 51 narrow as the member 51 approaches tip portion 52 as best shown in FIG. 2. In this regard, the tapered side edges of the spade devices 40 are best illustrated in FIG. 2 whereas the trapezoidal shape and surface area of plate member 51 is best illustrated in FIG. 3.

Arm portion 44 includes a longitudinal member having pivot mechanism 46 positioned at one end portion thereof and pivot mechanism 48 positioned at its opposite end portion. Pivot mechanism 46 is pivotally connected to an outer edge of orientation wheel 26 at a pivot point 47 and pivot mechanism 48 is pivotally connected to a corresponding pivot point 49 associated with plate member 32 of carrier wheel 24 as best illustrated in FIG. 2. Pivot mechanism 50 associated with each spade device 40 is similarly pivotally connected to an outer edge of the plate member 30 associated with carrier wheel 24 at a corresponding pivot point (not shown) similar to pivot point 49. When thus connected, each spade device 40 is oriented in a substantially vertical position regardless of the particular position of the spade devices 40 on the circumference of wheel assembly 22. Such vertical orientation is due to the vertical or radial offset between carrier wheel 24 and orientation wheel 26 by virtue of the substantially rigid member 34 positioned and coupled therebetween. The pivot points 47 at the outer edges of orientation wheel 26 and the pivot points 49 associated with the plate members 30 and 32 forming carrier wheel 24 must all be at a substantially identical radius, or distance, from the center axis of rotation of the respective wheels 24 and 26 in order for the spade devices 40 to remain substantially vertically oriented during 360° of rotation of the wheels 24 and 26.

In the particular embodiment of the present invention illustrated in FIGS. 2 and 3, there are ten spade devices 40 positioned in spaced apart relationship about the outer circumference of wheels 24 and 26. However, it is recognized and anticipated that the total number of spade devices 40 and the positioning thereof on wheels 24 and 26 may be varied to accommodate the particular requirements of a particular body of water, or to conform to the particular requirements or design of another embodiment of the present drive wheel assembly 22. For example, it might be preferable to have more than ten spade devices 40 in an embodiment having wheel assemblies 22 of a comparatively larger diameter for operation in deeper bodies of water and vice versa. Also, the opposed end portions of arm portion 44 may be pivotally coupled to the orientation and carrier wheels at locations other then the respective outer edge portions of orientation wheel 26 and carrier wheel plate members 30 and 32.

A drive mechanism is preferably provided to rotate carrier wheel 24 about axis member 28. It is recognized and anticipated that any suitable transmission, driving device or drive mechanism known in the art may be used to drive carrier wheel 24. In the embodiment illustrated in FIG. 3, a high reduction transmission gear box 54 is shown coupled to carrier wheel 24 and axis member 28 via chain sprocket 56 and roller chain 57. Other drive mechanisms can likewise be utilized. Further, in the preferred embodiment, the carrier wheel 24 associated with each wheel assembly 22 is independently controllable, and preferably may be driven in either a forward or a rearward direction.

During operation in a particular body of water, drive wheel assemblies 22 of the dredging apparatus 10 are preferably lowered to a height under the surface of the water wherein the spade devices 40 located at the bottom portion of wheel assemblies 22 engage the floor surface 60 (FIG. 2) of a particular body of water. The tapered blade portions 42 of the substantially vertical spade devices 40 along with their narrow tip portions 52 vertically penetrate the comparatively soft or loose material associated with the floor surface 60. Such vertical penetration of the blade portions 42 will not agitate the sediment material of floor surface 60 because the blade portions 42 first penetrate the floor surface vertically with the relatively narrow tip portions 60, and thereafter penetrate the floor surface with the tapered side edges of blade portion 42. As a result, the spade devices 40 enter and exit the floor surface 60 in a substantially vertical position thereby causing less of a disturbance or agitation as the spade devices 40 enter and exit the floor sediment. In this regard, the member 44 functions to maintain the vertical orientation of the spade devices 40 as they rotate about the wheel assemblies 22 as previously explained. The present drive wheel assemblies 22, including spade devices 40, therefore do not travel horizontally against the floor surface 60 as might occur with a conventional drive wheel assembly thereby agitating the sediment material at the surface of floor 60.

In order to propel or maneuver the dredging apparatus 10 across a body of water, the drive mechanism such as mechanisms 54, 56 and 58 rotate carrier wheel 24 of wheel assembly 22 in a desirable direction at a desirable speed. Those skilled in the art will appreciate that the rotation of carrier wheel 24 in a wheel assembly 22 will cause orientation wheel 26 in that wheel assembly 22 to rotate therewith at a substantially identical angular velocity. This is in part due to the vertically or radially offset position of orientation wheel 26 with respect to carrier wheel 24 which is maintained by pivotation member 34, and in part due to the pivotable connections of the arm portions 44 associated with each spade device 40 with orientation wheel 26 and carrier wheel 24. As carrier wheel 24 rotates, the arm portions 44 convey the motion to orientation wheel 26 whereby orientation wheel 26 rotates therewith. Since the arm portions 44 are pivotally connected to both wheels, and since the distance between corresponding pivot points 47 and 49 on plate member 32 and orientation wheel 26 remain constant, that is, at a substantially identical vertically or radially offset distance with respect to each other, throughout rotation of the drive wheel assembly 22, spade devices 40 will pivot with respect to each wheel 24 and 26 as the wheels rotate, and the spade devices 40 will maintain their substantially vertical orientation throughout rotation of such wheels. In this regard, those skilled in the art will appreciate that the radius of each corresponding pivot point 47 and 49 on spoked plate member 32 and on orientation wheel 26 must be at a substantially identical radius from the center axis of the respective wheels in order for spade devices 40 to maintain their substantially vertical orientation during rotation of the wheels. With this configuration, spade devices 40 will maintain their substantially vertical orientation regardless of the angular position of the carrier wheel 24 and orientation wheel 26 relative thereto, and the spade devices 40 will maintain such substantially vertical orientation throughout a 360° rotation of carrier wheel 24 and orientation wheel 26.

As the carrier wheel 24 of each drive wheel assembly 22 is rotated, the substantially flat surface areas of blade portions 42, when buried in the sediment material under floor surface 60, push horizontally against the sediment material below the surface thereof. This horizontal pushing force is in significant part due to the vertical position of the spade devices 40 maintained by the offset relationship between the carrier wheel 24 and the orientation wheel 26. Those skilled in the art will appreciate that the force of the sediment material against blade portions 42 propels dredging apparatus 10 in a direction commensurate with such force. As the drive wheel assembly 22 continues to rotate, apparatus 10 is propelled relative to floor 60, and the blade portions 42 associated with the spade devices 40 located at the front portion of wheel assembly 22 strike and enter the surface of floor 60 in a substantial vertical position whereas the blade portions 42 associated with the spade devices 40 located at the back portion of wheel assembly 22 exit the floor surface 60 in a substantially vertical position, substantially opposite to the direction in which they entered and penetrated the floor 60. Such vertical penetration and exit from the sediment material causes a considerably minor amount of turbidity in the surrounding water. This cycle of vertical penetration of spade device 40 into floor surface 52, pushing horizontally against the sediment material under floor surface 60, and vertical exit thereof continues to repeat itself as the drive wheel assembly 22 continues to rotate.

Dredging apparatus 10 is thus propelled, which, as those skilled in the art will appreciate, may be propelled in either a forward or a rearward direction as the wheel assemblies 22 and spade devices 40 thereon will perform substantially identically in either direction of rotation of wheel assemblies 22. Further, controlling the rotation of each wheel assembly 22 independently will allow the dredging apparatus 10 to be maneuvered as desired, such as by moving one wheel assembly 22 faster or slower as compared to another wheel assembly 22.

Industrial Applicability

As described herein, the method and apparatus of the present invention has particular utility in all types of dredging operations and equipment wherein it is desirable to provide locomotion capability thereto. Typically, the wheel assemblies 22 of the present invention will be positioned and located one on each side of a dredging apparatus. However, it is recognized that any plurality of wheel assemblies 22 may be utilized with a particular dredging apparatus 10. For example, a relatively large dredging apparatus may have three or more drive wheel assemblies associated therewith. Accordingly, such variations and embodiments of the present invention are recognized and anticipated, and therefore it is intended that the claims shall cover all such embodiments of the present invention that do not depart from the spirit and scope of the present invention.

Those skilled in the art will appreciate that dredging apparatus having wheel assemblies according to the present invention can be navigated in a body of water by independently controlling the rotation of two or more wheel assemblies. If all wheel assemblies in a particular dredging apparatus rotate at the same speed and in the same direction, the dredging apparatus will be propelled commensurate with such rotation of the wheel assemblies. However, if one wheel assembly is turned faster or slower as compared to another wheel assembly positioned offset relative thereto, the dredging apparatus will be steered or turned in the direction of the net result of the independent propulsion contributed by each wheel assembly. Accordingly, desirable navigational capabilities may be achieved in a particular dredging apparatus by having the drive wheel assemblies 22 of the present invention function in cooperation with appropriate individual control mechanisms for each individual wheel assembly 22. Further, those skilled in the art will appreciate that the dredging apparatus may be propelled in either a forward or a rearward direction by controlling the direction of rotation of the wheel assemblies thereon. The present spade devices 40 will maintain their substantially vertical orientation and will penetrate and exit the floor of a particular body of water in substantially the same manner as described above regardless of the direction of travel. Accordingly, the wheel assemblies 22 of the present invention are suitable for dredging apparatus operable to conduct dredging operations in both a forward and a reverse direction of travel.

Tip portion 52 associated with each spade device 40 is preferably narrow and strong. During operation of drive wheel assembly 22, the tip portions 52 will strike the floor 60 of a body of water first, and the remainder of the blade portions 42 will follow therebehind. In the event that tip portion 52 encounters an object such as a rock or a piece of debris either at the floor surface or underneath the floor surface of a particular body of water, the narrow tip portion 52 should be sufficiently strong to either pierce through the object or to edge it aside whereby the tapered side edges of blade portions 42 may continue to push off of the sediment of floor surface 60 to achieve the desired propulsion. Accordingly, the narrow shape of tip portion 52 and the tapered side edges of blade portion 42 provide additional utility aside from the fact that the design and shape thereof result in a substantially reduced amount of turbidity during operation in a body of water.

It is recognized that variations to the construction and design of the present drive wheel assemblies 22 can be made without departing from the spirit and scope of the present invention. In this regard, particular features could be added or particular features could be eliminated from the construction of the wheel assemblies 22. In addition, as is evident from the foregoing description, certain aspects of the present invention are not limited by the particular details of the examples illustrated herein, and it is therefore contemplated that still other modifications and applications, or equivalents thereof, will occur to those skilled in the art. It is accordingly intended that the following claims shall cover all such modifications and applications that do not depart from the sprit and scope of the present invention.

Other aspects, objects and advantages of the present invention can be obtained from a study of the drawings, the disclosure and the appended claims.

What is claimed is:

1. A drive wheel assembly (22) adapted for use for propelling a dredging apparatus (10) in a body of water, the drive wheel assembly (22) comprising:

a carrier wheel (24) rotatably coupled to the dredging apparatus (10), the carrier wheel (24) including an axis member (28) at the center thereof defining the center of rotation of the carrier wheel (24), a first member (32) coupled to one end of said axis member and a second member (30) coupled to the other end of said axis member;

a pivotation member (34) having opposed end portions, one end portion of said pivotation member being coupled to the center axis member (28) of said carrier wheel (24);

an orientation wheel (26) pivotally connected to the opposed end portion (38) of said pivotation member (34); and a plurality of spade devices (40) pivotally connected to said carrier wheel (24) and to said orientation wheel (26), each spade device (40) including an arm portion (44) and a blade portion (42), each arm portion (44) having opposed end portions (46, 48), one end portion (46) of each arm portion (44) being pivotally coupled to the orientation wheel (26) and the opposite end portion (48) of each arm portion (44) being pivotally coupled to the first member (32) associated with said carrier wheel (24), each blade portion (42) having a portion (50) thereof pivotally coupled to the second member (30) associated with said carrier wheel (24) whereby said spade devices (40) are positioned in a substantially vertical orientation relation to the horizontal.

2. The drive wheel assembly (22) as set forth in claim 1, wherein said spade devices (40) remain in a substantially vertical orientation when said carrier wheel (24) is rotated about said axis member (28).

3. The drive wheel assembly (22) as set forth in claim 1, wherein the blade portion (42) of said spade devices (40) includes a plate member (51) having a substantially flat surface area with tapered side edges.

4. The drive wheel assembly (22) as set forth in claim 3, wherein said blade portion (42) terminates in a tip portion (52).

5. The drive wheel assembly (22) as set forth in claim 1, wherein said first (32) and second (30) carrier wheel members are spoked members.

6. The drive wheel assembly (22) as set forth in claim 1, wherein one end portion (46) of each arm portion (44) is pivotally coupled to an outer edge portion of said orientation wheel (26).

7. The drive wheel assembly (22) as set forth in claim 6, wherein the opposed end portion (48) of each arm portion (44) is pivotally connected to an outer edge portion of the first member (32) associated with the carrier wheel (24).

8. The drive wheel assembly (22) as set forth in claim 7, wherein a portion (50) of each blade portion (42) is pivotally coupled to an outer edge portion of the second member (30) associated with the carrier wheel (24).

9. The drive wheel assembly (22) as set forth in claim 1, further comprising a drive mechanism (54, 56, 58) to drive the carrier wheel (24).

10. The drive wheel assembly (22) as set forth in claim 1, wherein said pivotation member (34) provides a substantially vertical offset between the orientation wheel (26) and the carrier wheel (24).

11. The drive wheel assembly (22) as set forth in claim 1, wherein said pivotation member (34) provides a substantially radial offset between the orientation wheel (26) and the carrier wheel (24).

12. The drive wheel assembly (22) as set forth in claim 1, wherein said wheel assembly (22) is vertically adjustable with respect to the dredging apparatus (10).

13. The drive wheel assembly (22) as set forth in claim 1, wherein corresponding pivot connections (47, 49) on the orientation wheel (26), the first member (32) associated with the carrier wheel (24), and the second member (30) associated with the carrier wheel (24) are at a substantially identical radius from the center axis of rotation of the respective wheels (24, 26).

14. The drive wheel assembly (22) as set forth in claim 1, wherein the rotation of the carrier wheel (24) drives the orientation wheel (26) at a substantially identical angular velocity.

15. The drive wheel assembly (22) as set forth in claim 1, wherein the plurality of spade devices (40) maintain their substantially vertical orientation at any angular position of said carrier (24) and orientation (26) wheels.

16. A drive wheel assembly (22) coupled to a dredging apparatus (10) for maneuvering the dredging apparatus (10) in a body of water, the drive wheel assembly (22) comprising:

a carrier wheel (24) rotatably connected to the dredging apparatus (10), said carrier wheel (24) including an axis member (28) defining the center of rotation of said carrier wheel (24) and a pair of first (32) and second (30) plate members coupled to said axis member (28) in spaced apart relationship relative to each other;

an orientation wheel (26) having an axis of rotation spaced from the axis of rotation of said carrier wheel (24);

a pivotation member (34) having opposed end portions, one end portion of said pivotation member being substantially rigidly connected to the axis member (28) of said carrier wheel (24) and the opposed end portion (38) of said pivotation member (34) being pivotally connected to said orientation wheel (26) at the axis of rotation thereof; and a plurality of spade devices (40) pivotally connected to said carrier (24) and orientation (26) wheels, each spade device (40) including an arm portion (44) and a blade portion (42), each arm portion (44) having a pivot mechanism (46, 48) associated with each opposite end portion thereof, one pivot mechanism (46) associated with each arm portion (44) being pivotally coupled to an outer portion of the orientation wheel (26) and the other pivot mechanism (48) associated with each arm portion (44) being pivotally coupled to an outer portion of the first plate member (32) associated with said carrier wheel (24) and to the blade portion (42), each blade portion (42) further including a pivot mechanism (50) pivotally coupled to an outer portion of the second plate member (30) associated with said carrier wheel (24) whereby each spade device (40) is positioned in a substantially vertical orientation relative to the horizontal, said plurality of spade devices (40) remaining in a substantially vertical orientation when said carrier wheel (24) is rotated about its axis member (28).

17. The drive wheel assembly (22) as set forth in claim 16, wherein the blade portion (42) of said spade devices (40) comprises a plate member (51) having a substantially trapezoidal shape with a substantially flat surface area on each opposite side thereof, said plate member (51) having tapered side edges.

18. The drive wheel assembly (22) as set forth in claim 16, wherein the blade portion (42) of said spade devices (40) comprises a plate portion (51) having a substantially trapezoidal shape with a substantially flat surface area associated with each opposite side thereof, said plate portion (51) having tapered edges which terminate in a substantially narrow tip portion (52).

19. The drive wheel assembly (22) as set forth in claim 16, further comprising a drive mechanism (54, 56, 58) to drive the carrier wheel (24) about said axis member (28).

20. The drive wheel assembly (22) as set forth in claim 16, wherein said drive wheel assembly (22) is vertically adjustable with respect to the dredging apparatus (10).

21. The drive wheel assembly (22) as set forth in claim 16, wherein the distance between the axis of rotation of the orientation wheel (26) and the location where the pivot mechanism (46) of the arm portion (44) couples to the outer portion of the orientation wheel (26) is substantially identical to the distance between the axis of rotation of the carrier wheel (24) and the location where the pivot mechanism (48) of the arm portion (44) and the pivot mechanism (50) of the blade portion (42) coupled respectively to the second (32) and first (30) plate members of the carrier wheel.

22. The drive wheel assembly (22) as set forth in claim 16, wherein the rotation of the carrier wheel (24) drives the orientation wheel (26) at a substantially identical angular velocity about the pivot mechanism of said pivotation member (28) coupled thereto.

23. A method for assembling a drive wheel assembly (22) adapted for use for propelling a dredging apparatus (10) in a body of water, comprising the steps of:

rotatably coupling a carrier wheel (24) to the dredging apparatus (10), the carrier wheel (24) including an axis member (28) at the center thereof defining the center of rotation of the carrier wheel (24);

coupling a first member (32) to one end of said axis member;

coupling a second member (30) to the other end of said axis member;

pivotally connecting an orientation wheel (26) to the opposed end portion (38) of a pivotation member (34), said pivotation member (34) having opposed end portions, one end portion of said pivotation member being coupled to the center axis member (28) of said carrier wheel (24);

pivotally connecting a plurality of spade devices (40) to said carrier wheel (24) and to said orientation wheel (26), each spade device (40) including an arm portion (44) and a blade portion (42), each arm portion (44) having opposed end portions (46, 48);

pivotally coupling one end portion (46) of each arm portion (44) to the orientation wheel (26);

pivotally coupling the opposite end portion (48) of each arm portion (44) to the first member (32) associated with said carrier wheel (24);

pivotally coupling each blade portion (42) having a portion (50) thereof to the second member (30) associated with said carrier wheel (24); and positioning said spade devices (40) in a substantially vertical orientation relation to the horizontal.

24. The method for assembling a drive wheel assembly (22) as set forth in claim 23, wherein said spade devices (40) remain in a substantially vertical orientation during said step of rotating said carrier wheel (24) about said axis member (28).

25. The method for assembling a drive wheel assembly (22) as set forth in claim 23, wherein the blade portion (42) of said spade devices (40) includes a plate member (51) having a substantially flat surface area with tapered side edges.

26. The method for assembling a drive wheel assembly (22) as set forth in claim 23, wherein said first (32) and second (30) carrier wheel members are spoked members.

27. The method for assembling a drive wheel assembly (22) as set forth in claim 23, further including the step of pivotally coupling one end portion (46) of each arm portion (44) to an outer edge portion of said orientation wheel (26).

28. The method for assembling a drive wheel assembly (22) as set forth in claim 27, further including the step of pivotally connecting the opposed end portion (48) of each arm portion (44) to an outer edge portion of the first member (32) associated with the carrier wheel (24).

29. The method for assembling a drive wheel assembly (22) as set forth in claim 28, further including the step of pivotally coupling a portion (50) of each blade portion (42) to an outer edge portion of the second member (30) associated with the carrier wheel (24).

30. The method for assembling a drive wheel assembly (22) as set forth in claim 23, further including the step of utilizing a drive mechanism (54, 56, 58) to drive the carrier wheel (24).

31. The method for assembling a drive wheel assembly (22) as set forth in claim 23, further including the step of providing a substantially vertical offset with said pivotation member (34) between the orientation wheel (26) and the carrier wheel (24).

* * * * *